US008052813B2

(12) United States Patent
Bass

(10) Patent No.: US 8,052,813 B2
(45) Date of Patent: Nov. 8, 2011

(54) IGNITION COMPOSITION AND APPLICATIONS

(75) Inventor: Alain Bass, Upie (FR)

(73) Assignee: Cheddite France, Bourg les Valence (FR)

( * ) Notice: Subject to any disclaimer, the term of this patent is extended or adjusted under 35 U.S.C. 154(b) by 390 days.

(21) Appl. No.: 12/223,747

(22) PCT Filed: Feb. 23, 2007

(86) PCT No.: PCT/FR2007/000326

§ 371 (c)(1),
(2), (4) Date: Aug. 25, 2008

(87) PCT Pub. No.: WO2007/096529

PCT Pub. Date: Aug. 30, 2007

(65) Prior Publication Data

US 2009/0151825 A1 Jun. 18, 2009

(30) Foreign Application Priority Data

Feb. 24, 2006 (FR) ..... 06 01644

(51) Int. Cl.

| | |
|---|---|
| ***C06B 47/08*** | (2006.01) |
| ***C06B 33/00*** | (2006.01) |
| ***C06B 33/08*** | (2006.01) |
| ***C06B 33/02*** | (2006.01) |
| ***D03D 23/00*** | (2006.01) |
| ***D03D 43/00*** | (2006.01) |

(52) U.S. Cl. ..... 149/36; 149/37; 149/38; 149/44; 149/108.6; 149/109.4

(58) Field of Classification Search ..... 149/36, 149/37, 38, 44, 108.6, 109.6
See application file for complete search history.

(56) References Cited

U.S. PATENT DOCUMENTS

| | | | | |
|---|---|---|---|---|
| 3,428,502 | A * | 2/1969 | Evans | 149/19.4 |
| 3,860,462 | A * | 1/1975 | Sayles | 149/19.8 |
| 4,056,416 | A | 11/1977 | Franklin et al. | |
| 4,133,707 | A | 1/1979 | Andrew | |
| 4,336,084 | A | 6/1982 | Urs | |
| 5,672,219 | A * | 9/1997 | Rinaldi et al. | 149/37 |
| 5,684,268 | A * | 11/1997 | Lopata | 149/39 |
| 6,620,267 | B1 * | 9/2003 | Guindon et al. | 149/63 |
| 6,663,731 | B1 * | 12/2003 | Rose et al. | 149/42 |
| 6,786,986 | B2 * | 9/2004 | Filho | 149/18 |
| 6,964,287 | B1 | 11/2005 | Nesveda et al. | |
| 2005/0183805 | A1 | 8/2005 | Pile et al. | |
| 2006/0219341 | A1 * | 10/2006 | Johnston et al. | 149/46 |
| 2007/0017612 | A1 * | 1/2007 | Hagel et al. | 149/38 |

FOREIGN PATENT DOCUMENTS

| | | | |
|---|---|---|---|
| EP | 0 047 406 | A2 | 3/1982 |
| EP | 1 216 215 | | 3/2001 |
| FR | 2 730 991 | A1 | 8/1996 |
| GB | 1 204 417 | | 9/1970 |
| GB | 2 313 372 | A | 11/1997 |
| WO | WO 2006/009579 | A2 | 1/2006 |

* cited by examiner

*Primary Examiner* — James McDonough
(74) *Attorney, Agent, or Firm* — Oliff & Berridge, PLC

(57) ABSTRACT

An ignition composition and its applications, the ignition composition including at least (a) an explosive fraction that includes at least one primary explosive, (b) an oxidation-reduction system and (c) an agglomerate. In the ignition composition the explosive fraction represents 9 to 35% by weight of the composition, the primary explosive at least is tetrazene, and tetrazene represents at least 95% by weight of said explosive fraction.

20 Claims, No Drawings

IGNITION COMPOSITION AND APPLICATIONS

The present invention relates to an initiation composition for incorporation in a pyrotechnic chain for producing an ignition, a separation or a destruction. An initiation composition is a mass of explosive material which serves to convert a generally mechanical action, for example percussion, into a pyrotechnic action, by causing a powder charge or explosive charge to ignite. The invention will be described more particularly in an application to shotgun or sports cartridges, but it is not limited to this use and is suitable for any system of deformation by explosion, for example in the automotive industry, for ignition for an airbag or a seat belt pretensioner.

An initiation composition conventionally consists of an explosive fraction comprising one or more primary explosives and one or more secondary explosives, a redox system and optionally a binder and a friction agent. Among primary explosives, mercury fulminate and lead azide, employed alone, are no longer used because of the excessive corrosion that they cause in the weapons, and the mercury-based or lead-based residues that they produce in the environment. Mixtures of primary explosives are generally used, selected from mixtures of lead trinitroresorcinate and tetrazene. Thus, compositions corresponding to the following formulation are sold on the market:

- an explosive fraction comprising, as primary explosive, about 35% of lead trinitroresorcinate and 3 to 4% of tetrazene, by weight relative to the total weight of the composition,
- a redox system, and
- a binder.

Lead-free initiation compositions have been developed more recently, with an explosive fraction consisting of mixtures of diazodinitrophenol and tetrazene, with for each of them a tetrazene content of up to 40% by weight relative to the total weight of the composition.

FR-A-2 730 991 discloses an initiation composition for cartridges of light weapons, comprising 20-40% by weight of diazodinitrophenol and 5-20% by weight of tetrazene, and a redox system comprising metals and tin oxides. EP-A-1 216 215 describes an initiation composition comprising 5-40% by weight of an explosive selected from nitroesters and nitramines, 5-40% by weight of tetrazene, a redox system, a binder and a friction agent. The preferred compositions described always comprise an explosive fraction having a proportion of at least 50% by weight of the composition.

In this research into less harmful and less polluting compositions, the Applicant has discovered that tetrazene, or 1-(5-tetrazolyl)-4-guanyl tetrazene hydrate, can be used in an initiation composition, as predominant primary explosive, and that it can even be used as sole primary explosive, or even as sole component of the explosive fraction. This discovery has many advantages. First, the explosive fraction thereby obtained is lead-free. Moreover, and surprisingly, the use of tetrazene as predominant primary explosive or as sole primary explosive serves to lower the proportion of the explosive fraction in the initiation composition.

Thus, the invention relates to an initiation composition which comprises at least (a) an explosive fraction which comprises at least one primary explosive, (b) a redox system and (c) a binder, in which composition the explosive fraction accounts for 9 to 35% by weight of the composition, and the primary explosive at least is tetrazene, which accounts for at least 95% by weight of said explosive fraction. Preferably, the tetrazene accounts for at least 99% by weight of the explosive fraction.

A composition of the invention is thus obtained by a simplified method that avoids the need for an additional line for synthesizing another primary explosive, said composition being effective, even in the absence of any other primary explosive, or even of a secondary explosive.

Furthermore, the industrial process for synthesizing tetrazene, which requires reacting a nitrite salt with a neutral guanidine salt, produces mother liquors that are treated by a physicochemical destruction process, without generating pollutants containing heavy metals. More precisely, a preferred industrial process for obtaining tetrazene comprises the stirred reaction of an aqueous solution of a nitrite salt, for example sodium nitrite, with an aqueous solution of a neutral guanidine salt, for example a guanidine sulfate, in the absence of inorganic acid, and optionally in the presence of acetic acid and/or of a crystallization agent. To obtain a composition of the invention, the other ingredients are then mixed, the mixture is compressed and then dried.

According to a preferred alternative for obtaining a composition of the invention, a method is used whereby the tetrazene is formed in situ. According to this method, a dry mixture is prepared of a nitrite salt and a neutral guanidine salt, that is the reactants for preparing tetrazene, and the other components of the composition. An appropriate quantity of this dry mixture is then placed in the initiation cavity, the mixture is compressed and then humidified, this step causing the formation of the tetrazene, and the composition is finally dried. This process is suitable for all starting reactants for synthesizing tetrazene, in particular sodium nitrite and/or guanidine sulfate, and all components of a composition of the invention. This method is highly advantageous in that it combines handling safety with environmental safety.

The invention therefore also relates to a composition as described above, wherein the explosive fraction comprises no primary explosive other than tetrazene, and to a composition in which the explosive fraction consists exclusively of tetrazene.

The explosive fraction of a composition may, if necessary, comprise at least one secondary explosive. This may be selected from the secondary explosives well known to a person skilled in the art, and in particular from aromatic nitrate explosives such as tolite (or 2,4,6-trinitrotoluene, 2,4,6-TNT), melinite (or picric acid) and trinitroaniline (or picramide or trinitroamine benzene); nitric ester explosives such as pentrite (or pentaerythritol tetranitrite, PETN) and nitrate esters of cellulose; and nitramine explosives, such as hexogen (or cyclotrimethylene-trinitramine, RDX), tetryle (or 2,4,6-trinitrophenylmethylnitramine), nitroguanidine and octogen (or cyclotetramethylene-tetranitramine, HMX).

A composition of the invention advantageously has the following features, considered independently or in combination.

The oxidizing agent or agents of the redox system (b) are selected from chemically stable oxidizing agents and in particular from barium nitrite, zinc oxides, zinc sulfate, copper oxide, copper nitrate, manganese oxides, ferric oxides, potassium chlorate, sodium chlorate, chromium oxide, carbonates and mixtures thereof.

The reducing agent or agents of the redox system (b) are selected from organic reducing agents, metals and metal salts, celluloses and cellulose derivatives, these being optionally nitrated. By way of example, the reducing agent or agents of the redox system (b) are selected from aluminum, magnesium, zirconium and antimony sulfide.

The lists of oxidizing and reducing agents given above are not exhaustive, and a person skilled in the art may make use of any other stable redox system which is compatible with the explosive fraction according to the invention, without affecting the effectiveness of the composition.

The proportion of the redox system (b) preferably varies between 65 and 81% by weight relative to the weight of the composition.

The binder (c) is advantageously selected from cellulose gums such as gum arabic, gum tragacanth and gum acacia. If the binder is necessary, or even indispensable, its proportion in the composition may be very low, and it generally varies between 0.01 and 5% by weight.

A preferred composition according to the invention comprises:

15 to 25% of tetrazene,
40 to 60% of barium nitrate,
18 to 30% of antimony sulfide,
5 to 12% of aluminum powder,
a binder.

To increase the sensitivity of the explosive fraction, a composition may comprise at least one chemically inert friction agent. Such an agent is for example selected from glass powder, diamond powder, carbide powder, ceramic, nitrides such as titanium nitride. The proportion of the friction agent preferably does not exceed 15% by weight relative to the weight of the composition.

As stated above, a composition of the invention may be used in various fields, in particular for the fabrication of blasting, shotgun, sports and defense cartridges, for smooth-bore and rifled-bore weapons, in the automotive industry for the fabrication of airbags or seat belt pretensioners, or for any other article using pyrotechnic energy, or for sealing techniques using explosive cartridges. It may also find applications in medical injection techniques, for example for intradermal or subcutaneous administration of a medicament or a vaccine.

The features and advantages of the invention, and particularly the performance of a composition of the invention, are illustrated in the following comparative examples.

EXAMPLE 1

Comparison of Ballistic Characteristics Between a Composition of the Invention and a Prior Art Composition The compared compositions correspond to the following formulations:

Composition of the Invention:

20% tetrazene
48% barium nitrate
8% aluminum powder
24% antimony sulfide binder.

The proportion of the binder is low compared to those of the other components of the exemplary composition. The percentages of the components indicated have a certain absolute uncertainty, and the incorporation of the binder does not significantly change the formulation of this composition.

The explosive fraction (a) in such a composition of the invention only accounts for 20% of said composition. This composition constitutes an advantageous variant of the invention in that the explosive fraction (a) consists exclusively of tetrazene.

Prior Art Composition:

30-35% lead trinitroresorcinate
2-5% tetrazene
30-45% barium nitrate
10-20% antimony sulfide binder.

The remark relating to the proportion of binder mentioned above applies to this prior art composition.

The explosive fraction in such a composition accounts for 32-40% of said composition.

These two compositions were tested under the same conditions during three tests, a percussion sensitivity test, a ballistic test and a full-scale blind test.

1) Percussion Sensitivity Test

This test serves to measure the aptitude of a composition to respond to the percussion of the weapon and to meet the safety standards.

A standard drop-ball apparatus is used. A 56 g ball is released from a height H on a striker, causing the charge to explode or not. The initiation composition is placed in a cavity in which it is protected by a blotting paper.

Based on this test, statistical calculations according to Henry's law are determined, thereby serving to characterize a composition and to evaluate the limits of its non-functioning safety and the drop height, expressing the energy at which said composition always functions reliably.

The results obtained on three batches of a composition of the invention are given in Table 1 below, in which H is the average drop height, S is the standard deviation determined on this height, and the parameter H+5s corresponds to the function threshold corresponding to 100% functioning.

The tested composition is the one described at the beginning of the example, with a variation in the proportion of tetrazene given in the table and compensated by the proportion of barium nitrate.

TABLE 1

| | Batch 20 20% tetrazene | Batch 21 18% tetrazene | Batch 22 23% tetrazene | Batch 20 20% Tetrazene | Batch 21 18% tetrazene | Batch 22 23% tetrazene |
|---|---|---|---|---|---|---|
| Weight of initiation composition (mg) | 61 | 61 | 58 | 68 | 70 | 72 |
| Basis weight of blotting paper | 120 | 120 | 120 | 120 | 120 | 120 |
| H (mm) | 72 | 75 | 64 | 71 | 86 | 87 |
| S | 0.539 | 0.594 | 0.939 | 0.440 | 0.642 | 0.570 |
| H + 5s | 126 | 135 | 158 | 122 | 150 | 145 |

These results are similar to those obtained with a prior art composition as described above and tested under the same conditions.

2) Ballistic Test

During these tests, the pressure in the barrel and the speed of the projectiles at predefined distances. These tests were performed according to CIP and were measured SAAMI standards.

After having prepared skirted wad cartridges, loaded with a commercially available powder and a lead shot charge, and initiated by a composition of the invention or a prior art composition, these cartridges are placed in a testing apparatus, called blasting gun.

Tests were conducted in triplicate on the composition of the invention, for a lead shot charge of 36 g and another of 32 g.

The measured values are as follows:

P1 is the pressure expressed in bar and measured in the blasting gun, at 25 mm from the shell base: this measurement is taken using a piezoelectric sensor;

$S_{P1}$ is the standard deviation determined on this pressure;

V1 is the speed expressed in ms of the lead shot shower calculated at one meter from the muzzle: it is the average of two speeds, one measured at the muzzle and the other measured at two meters from the muzzle;

$S_{V1}$ is the standard deviation determined on this speed;

V2 is the mean speed expressed in ms of the lead shot shower calculated between the optical barrier positioned at two meters from the muzzle and another optical barrier positioned at 17 meters. A computer determines this mean;

$S_{V2}$ is the standard deviation determined on this speed;

Tc is the combustion time, also called barrel-time, and is the time expressed in microseconds, which elapses between the impact on the striker and the passage of the lead shot in front of the cell located at the muzzle; and $S_{Tc}$ is the standard deviation determined on this time.

The measurements obtained are given in Tables 2 and 3 below. Table 2 corresponds to the tests conducted with a lead shot charge of 36 g, and Table 3 corresponds to those conducted with a lead shot charge of 32 g.

TABLE 2

| | P1 | $S_{P1}$ | V1 | $S_{V1}$ | V2 | $S_{V2}$ | Tc | $S_{Tc}$ |
|---|---|---|---|---|---|---|---|---|
| Prior art | 664 | 33 | 386 | 5 | 336 | 4 | 3065 | 89 |
| Invention test 1 | 662 | 30 | 386.6 | 4 | 335 | 4.7 | 3178 | 270 |
| Invention test 2 | 661 | 25 | 386 | 4 | 335 | 4 | 3170 | 70 |
| Invention test 3 | 662 | 35 | 387 | 5 | 335 | 4 | 3129 | 99 |

TABLE 3

| | P1 | $S_{P1}$ | V1 | $S_{V1}$ | V2 | $S_{V2}$ | Tc | $S_{Tc}$ |
|---|---|---|---|---|---|---|---|---|
| Prior art | 592 | 32 | 402 | 4.8 | 345 | 3 | 3043 | 93 |
| Invention test 1 | 583 | 30 | 401 | 5.5 | 345 | 4 | 3078 | 117 |
| Invention test 2 | 585 | 29 | 400 | 5.5 | 344 | 4 | 3075 | 100 |
| Invention test 3 | 582 | 32 | 400 | 5.6 | 343 | 4.8 | 3091 | 117 |

It appears from these results that the ballistic performance of a composition of the invention is reproducible and is at least as high as that of a prior art composition.

3) Full-Scale Blind Ballistic Test

Experienced marksmen performed blind tests on the cartridges equipped with the initiation compositions to be evaluated, in competition shooting galleries or during hunting.

These tests confirmed that the performance of the compositions of the invention is at least similar to that of the prior art compositions.

The invention claimed is:

1. An initiation composition comprising at least (a) an explosive fraction which comprises at least one primary explosive, (b) a redox I system and (c) a binder, wherein the explosive fraction accounts for 9 to 35% by weight of the composition, the primary explosive at least is tetrazene, the tetrazene accounts for at least 95% by weight of said explosive fraction, and the redox system accounts for from 65 to 81% by weight relative to the weight of the composition and is free from stannic oxide.

2. The composition as claimed in claim 1, wherein the tetrazene accounts for at least 99% by weight of said explosive fraction.

3. The composition as claimed in claim 1, wherein the explosive fraction comprises no primary explosive other than tetrazene.

4. The composition as claimed in claim 1, wherein the explosive fraction consists of tetrazene.

5. The composition as claimed in claim 1, wherein the explosive fraction comprises at least one secondary explosive.

6. The composition as claimed in claim 5, wherein the secondary explosive or explosives of the explosive fraction are selected from aromatic nitrate explosives; nitric ester explosives; and nitramine explosives.

7. The composition as claimed in claim 1, wherein it is lead-free.

8. The composition as claimed in claim 1, wherein the oxidizing agent or agents of the redox system (b) are selected from barium nitrite, zinc oxides, zinc sulfate, copper oxide, copper nitrate, manganese oxides, ferric oxides, potassium chlorate, sodium chlorate, chromium oxide, carbonates and mixtures thereof.

9. The composition as claimed in claim 1, wherein the reducing agent or agents of the redox system (b) are selected from organic reducing agents, metals and metal salts, celluloses and cellulose derivatives, these being optionally nitrated.

10. The composition as claimed in claim 9, wherein the reducing agent or agents of the redox system (b) are selected from aluminum, magnesium, zirconium and antimony sulfide.

11. The composition as claimed in claim 1, wherein the binder (c) is selected from cellulose gums.

12. The composition as claimed in claim 1, wherein the proportion of the binder (c) varies between 0.01 and 5% by weight relative to the weight of the composition.

13. The composition as claimed in claim 1, wherein it comprises:

15 to 25% of tetrazene, 40 to 60% of barium nitrate, 18 to 30% of antimony sulfide, 5 to 12% of aluminum powder, and a binder.

14. The composition as claimed in claim 1, wherein it comprises at least one chemically inert friction agent, promoting the sensitivity of the explosive fraction.

15. The composition as claimed in claim 14, wherein said agent is selected from glass powder, diamond powder, carbide powder, ceramic, and nitrides.

16. The composition as claimed in claim 14, wherein the proportion of the friction agent does not exceed 15% by weight relative to the weight of the composition.

17. A method of fabricating blasting shotgun, sports and defense cartridges comprising fabricating said cartridges with the composition of claim 1.

18. A method of fabricating airbags, ignition systems and seat belt pretensioners comprising fabricating the airbags, ignition systems and seat belt pretensioners with the composition of claim 1.

19. A method of sealing with explosive cartridges comprising explosive cartridges containing the composition of claim 1.

20. A method of injecting a medical substance comprising injecting with a propellant comprising the composition of claim 1.

* * * * *